US008220283B2

(12) United States Patent
Meyerholtz et al.

(10) Patent No.: US 8,220,283 B2
(45) Date of Patent: Jul. 17, 2012

(54) ICE CRUSHING MECHANISM

(75) Inventors: Eric R. Meyerholtz, Evansville, IN (US); Richard A. Webster, Evansville, IN (US); Dawn M. Kracker, Evansville, IN (US); Patrick J. Boarman, Evansville, IN (US); Gary W. Wilson, Sellersburg, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 826 days.

(21) Appl. No.: 11/870,439

(22) Filed: Oct. 11, 2007

(65) Prior Publication Data

US 2008/0148759 A1 Jun. 26, 2008

Related U.S. Application Data

(60) Provisional application No. 60/876,344, filed on Dec. 21, 2006.

(51) Int. Cl.
*F25C 5/02* (2006.01)

(52) U.S. Cl. ..... 62/320; 62/DIG. 17

(58) Field of Classification Search ..... 62/320; 241/DIG. 17

See application file for complete search history.

(56) References Cited

U.S. PATENT DOCUMENTS

| | | | | |
|---|---|---|---|---|
| 3,075,363 | A | | 1/1963 | Conto |
| 3,101,872 | A | | 8/1963 | Dickinson |
| 3,412,909 | A | | 11/1968 | Callen |
| 3,744,679 | A | | 7/1973 | Nitschneider et al. |
| 3,881,642 | A | * | 5/1975 | Hoenisch ..... 222/370 |
| 4,090,641 | A | | 5/1978 | Lindenschmidt |
| 4,102,660 | A | | 7/1978 | Beckett et al. |
| 4,123,918 | A | | 11/1978 | Kohl et al. |
| 4,227,383 | A | | 10/1980 | Horvay |
| 5,680,771 | A | | 10/1997 | Yoo et al. |
| 6,082,130 | A | * | 7/2000 | Pastryk et al. ..... 62/344 |
| 6,135,173 | A | | 10/2000 | Lee et al. |
| 6,425,259 | B2 | | 7/2002 | Nelson et al. |
| 6,655,166 | B1 | * | 12/2003 | Williams ..... 62/320 |
| 7,111,473 | B2 | * | 9/2006 | Chung et al. ..... 62/320 |
| 7,278,275 | B2 | * | 10/2007 | Voglewede et al. ..... 62/320 |
| 2006/0207270 | A1 | | 9/2006 | Voglewede et al. |

FOREIGN PATENT DOCUMENTS

JP 4165278 A 6/1992

* cited by examiner

*Primary Examiner* — Cheryl J Tyler
*Assistant Examiner* — Lakiya Rogers
(74) *Attorney, Agent, or Firm* — Kirk W. Goodwin; Greer, Burns & Crain LLP

(57) ABSTRACT

An ice making and storing system which may be mounted in a refrigeration appliance. The ice making and storing system includes an ice making mechanism, a removable ice storage receptacle positioned adjacent to the ice making mechanism, an insulated cover for the ice making mechanism with a portion engageable with the ice storage receptacle to provide a thermally tight seal between the cover and the ice storage receptacle.

19 Claims, 4 Drawing Sheets

ICE CRUSHING MECHANISM

CROSS-REFERENCE TO RELATED APPLICATION

The present application claims the benefit of U.S. Provisional Patent Application Ser. No. 60/876,344 filed Dec. 21, 2006 entitled "Ice Crushing Mechanism".

BACKGROUND OF THE INVENTION

Ice crushing mechanisms are known, particularly those used in refrigeration appliances. U.S. Pat. Nos. 6,082,130 and 7,111,473 disclose an ice crushing mechanism in a refrigeration appliance. U.S. Pat. No. 4,123,918 discloses an ice dispensing machine with rotatable keeper elements for moving ice towards a discharge opening.

In an ice dispenser, and particularly those used in refrigeration appliances, freezer air is permitted to flow through the ice chute to the exterior of the appliance due to an open flow path through the ice dispenser, which may include an ice crushing mechanism. This causes condensation to occur on the ice chute door and in the dispenser housing. As the condensation occurs, water will begin to drip from the dispenser into the dispenser tray. This may cause the user of the appliance to believe that service is required to "fix the leak", resulting in an unnecessary service call.

Also, the ice crushing blades are sometimes accessible from the opening of the ice dispenser chute which can lead to the entry of foreign objects into the area of the ice crushing blades, resulting in damage to the blades or the foreign object, or stalling of the motor driving the blades.

It would be an improvement in the art if there were provided an ice crushing mechanism which prevents the direct access of air from the freezer to the ice chute. Also, it would be an improvement if there were provided an ice crushing mechanism which prevents direct access to the ice crushing blades from the ice chute.

SUMMARY OF THE INVENTION

The present invention provides an ice crushing mechanism which, in some embodiments, may be mounted in a refrigeration appliance having a refrigerated compartment and an ice making mechanism.

The ice crushing mechanism includes a housing, a first chamber formed in the housing and defined by a first bottom wall with an opening therein, and a second chamber formed below the first chamber in the housing and defined on the top by the first bottom wall of the first chamber and also by a second wall with an opening therein angularly offset from the first bottom wall opening. A rotatable spindle is positioned in the housing extending essentially vertically through both the first and second chambers. At least one ice crushing blade is rotatably carried on the spindle and is positioned in the first chamber. A wiper is rotatably carried on the spindle and positioned in the second chamber. The second chamber, below the ice crushing chamber, with the offset opening from the second chamber prevents direct access from that opening to the ice crushing blades.

The second wall, which defines the second chamber may be a bottom wall of the second chamber, or it may be a surrounding wall of the second chamber.

In an embodiment, the first chamber may be further defined by a top wall with an opening therein angularly offset from the first bottom wall opening.

In an embodiment, the openings in the first bottom wall and the second wall each have an angular extent of less than 90 degrees.

In an embodiment, the first chamber and the second chamber are each defined by a circular outer wall.

In an embodiment, the wiper comprises at least one arm attached to be rotatably driven by the spindle with a free end terminating closely adjacent to the outer wall defining the second chamber.

In an embodiment, the wiper arm is made of a flexible and resilient material.

In an embodiment, the wiper arm comprises three arms attached to be rotatably driven by the spindle, each with a free end terminating closely adjacent to the outer wall defining the second chamber.

In an embodiment, the ice crushing mechanism may include a housing, a first chamber formed in the housing and defined by a top wall with a first opening therein, a first bottom with a second opening having an angular extent of no more than 110 degrees therein angularly offset from the top wall opening and a circular outer wall, a second chamber formed below the first chamber in the housing and defined on the top by the first bottom wall of the first chamber, on the bottom by a lower, second bottom wall with a third opening having an angular extent of no more than 110 degrees therein angularly offset from the first bottom wall opening by approximately 180 degrees and a circular outer wall. A rotatable spindle is positioned in the housing extending essentially vertically through a central portion of both the first and second chambers. At least one ice crushing blade is rotatably carried on the spindle and positioned in the first chamber. A wiper is rotatably carried on the spindle and positioned in the second chamber, the wiper comprising a plurality of arms, each attached to be rotatably driven by the spindle and each with a free end terminating closely adjacent to the outer wall. The arms of the wiper are angularly spaced apart from each other such that at least two arms block all paths between the second opening and the third opening. In this manner, direct access of air from the freezer to the ice chute is prevented.

In an embodiment, the openings in the top wall, the first bottom wall and the second bottom wall each have an angular extent of less than 90 degrees.

In an embodiment, the wiper arm is made of a flexible and resilient material.

DETAILED DESCRIPTION OF THE PREFERRED EMBODIMENT

Figure 1:
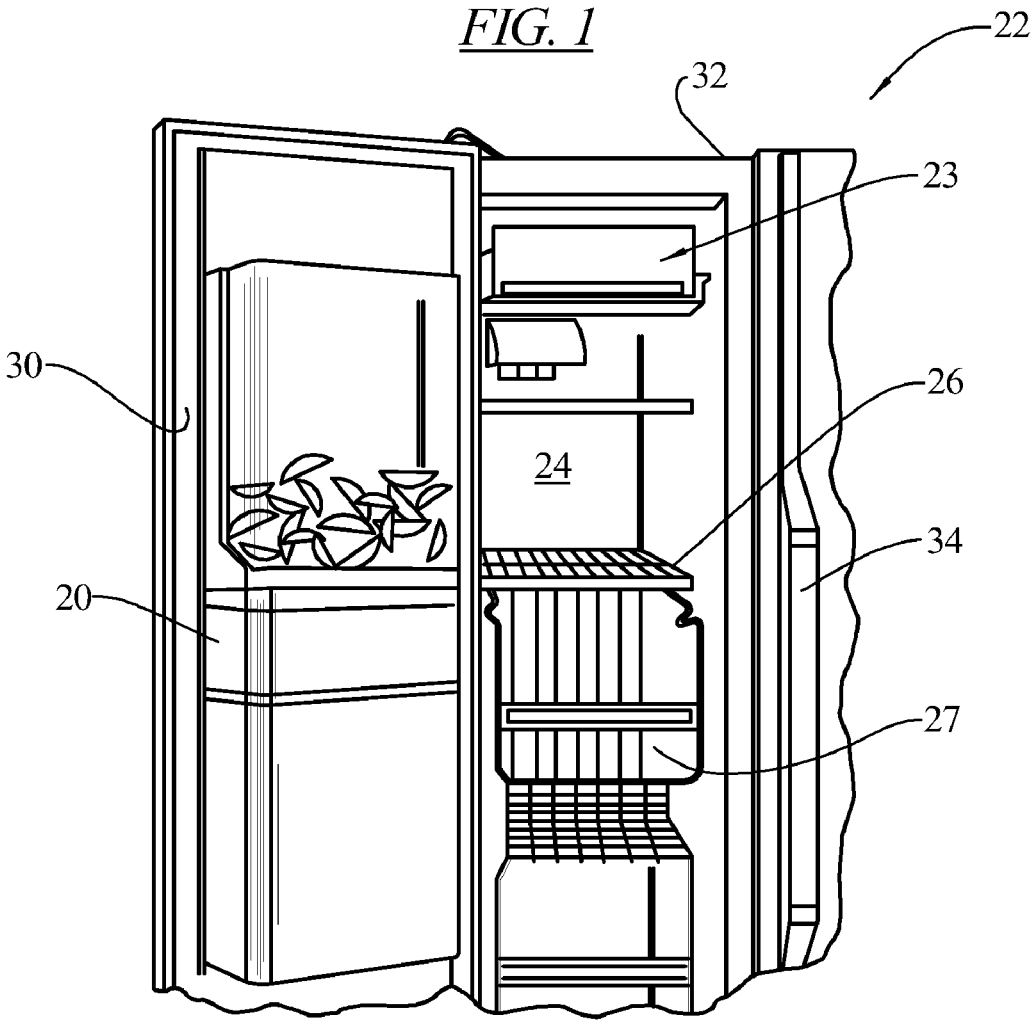
FIG. 1 is a front elevational view of a refrigeration appliance incorporating an ice crushing mechanism embodying the principles of the present invention.

As illustrated in FIG. 1, the present invention provides an ice crushing mechanism 20 which, in some embodiments, may be mounted in a refrigeration appliance 22 which includes an ice making mechanism 23. In the embodiment shown in FIG. 1, the refrigeration appliance 22 includes a refrigerated compartment 24. In this compartment may be located various shelves 26 and drawers 27 for storing food items. The ice crushing mechanism 20 may be located on a door 30 of the cabinet 32 of the appliance 22, as shown, or it may be located in the main refrigerated compartment 24. The refrigeration appliance 22 may also include a second compartment 34 which could be maintained at a different temperature than the first compartment, and the ice crushing mechanism 20 could be located in either compartment, such as one kept above freezing or one kept below freezing.

Figure 2:
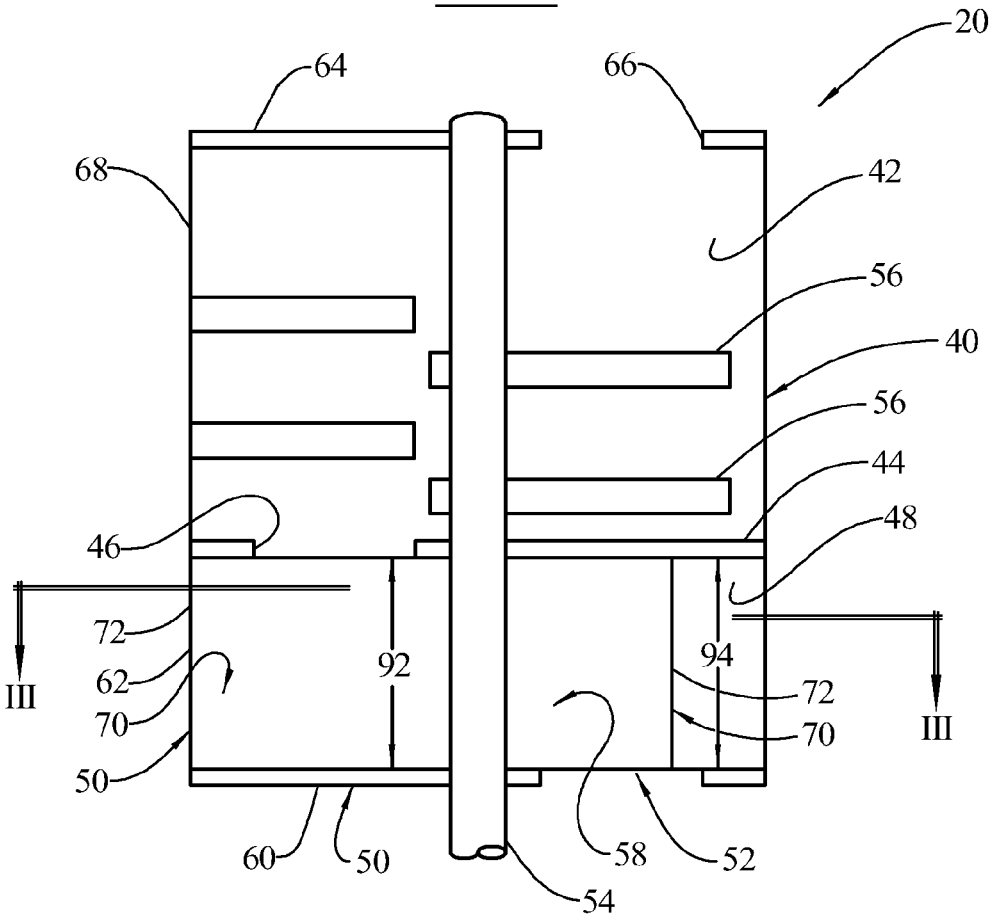
FIG. 2 is a side sectional schematic view of the ice crushing mechanism.

As shown schematically in FIGS. 2 and 3, the ice crushing mechanism 20 includes a housing 40, a first chamber 42 formed in the housing and defined by a first bottom wall 44 with an opening 46 therein, and a second chamber 48 formed below the first chamber in the housing and defined on the top by the first bottom wall 44 of the first chamber and also by a second wall 50 with an opening 52 therein angularly offset from the first bottom wall opening 46. A rotatable spindle 54 is positioned in the housing 40 extending essentially vertically through both the first 42 and second 48 chambers. At least one ice crushing blade 56 is rotatably carried on the spindle 54 and is positioned in the first chamber 42. A wiper 58 is rotatably carried on the spindle 54 and positioned in the second chamber 48.

The second wall 50, which defines the second chamber 48 may be a bottom wall 60 of the second chamber, or it may be a surrounding wall 62 of the second chamber. The first chamber 42 may be further defined by a top wall 64 with an opening 66 therein angularly offset from the first bottom wall opening 46.

In an embodiment, the openings 46, 52 in the first bottom wall 44 and the second wall 50 each have an angular extent A of less than 90 degrees.

In an embodiment, the first chamber 42 and the second chamber 48 are each defined by a circular outer wall 68, 62. The two circular outer walls 68, 62 may have the same diameter, or they may have different diameters.

In an embodiment, the wiper 58 comprises at least one arm 70 attached to be rotatably driven by the spindle 54 with a free end 72 terminating closely adjacent to the outer wall 62 defining the second chamber 48. In an embodiment, the wiper arm 72 is made of a flexible and resilient material such that is a rigid obstacle is positioned between the wiper arm and an edge of either opening 46, 52, the arm will flex and the wiper 58 will continue rotating, without causing damage to the rigid obstacle.

Figure 3:
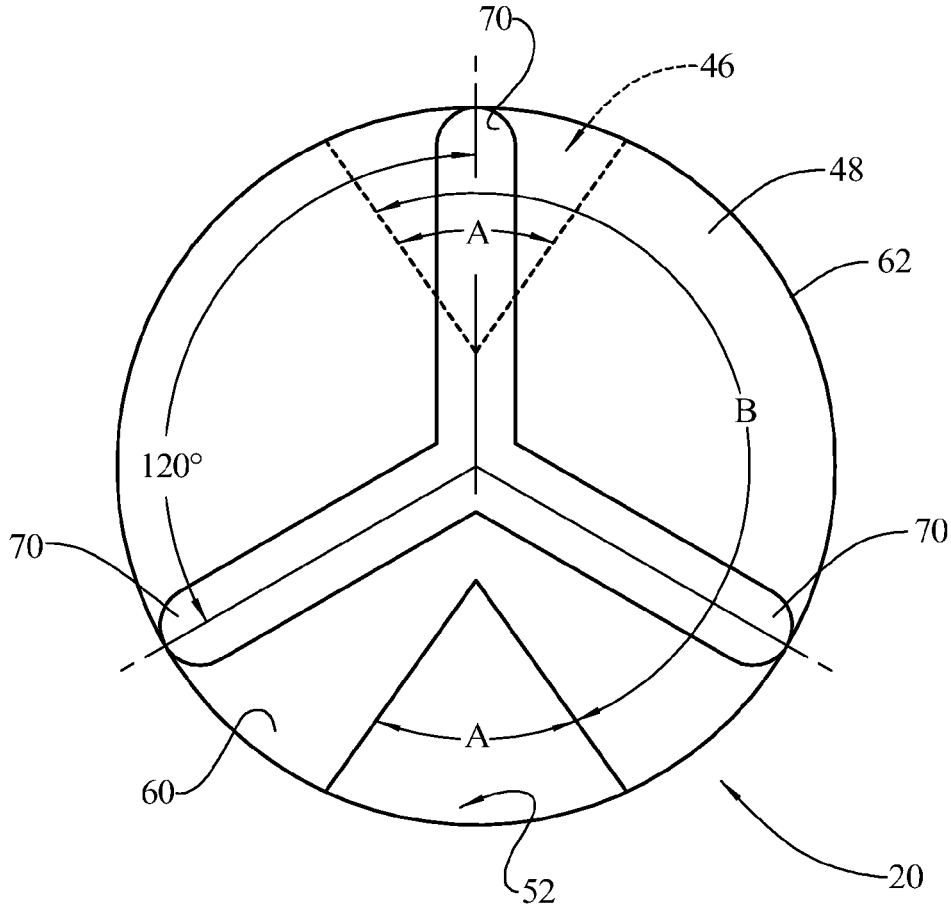
FIG. 3 is a top sectional view of the ice crushing mechanism taken generally along the line III-III of FIG. 2.
Figure 4:
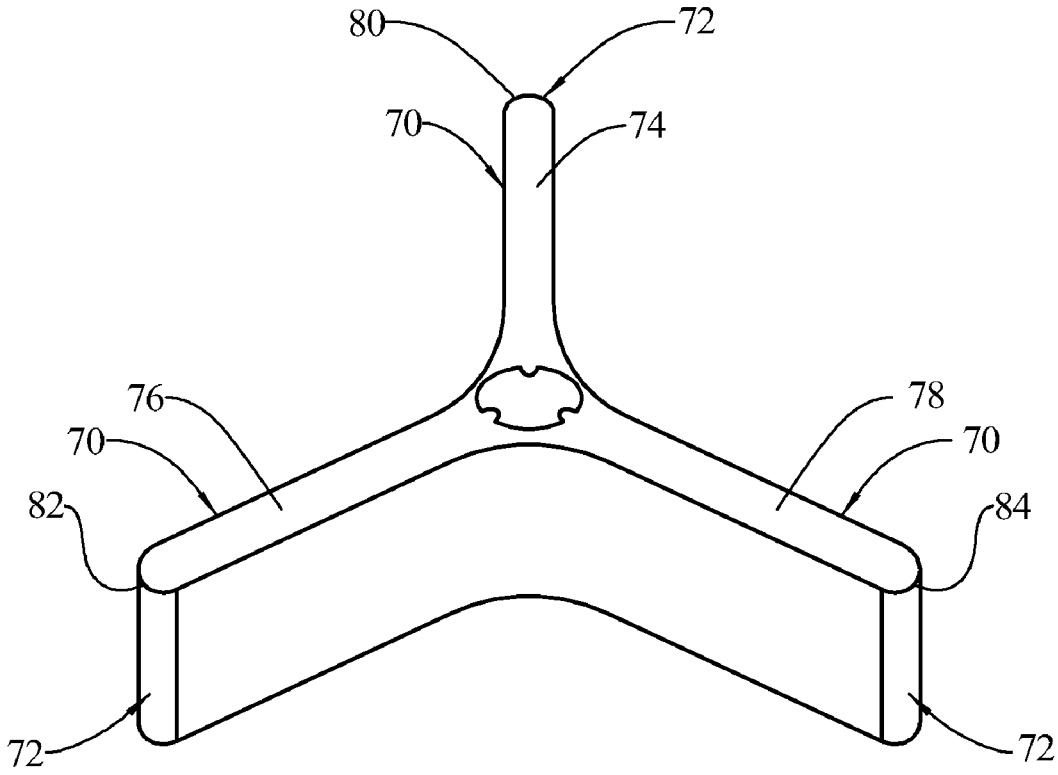
FIG. 4 is an isolated perspective view of the wiper used in the ice crushing mechanism.

In an embodiment as shown in FIGS. 3 and 4, the wiper arm 72 comprises three arms 74, 76, 78 attached to be rotatably driven by the spindle 54, each with a free end 80, 82, 84 terminating closely adjacent to the outer wall 62 defining the second chamber 48.

In an embodiment, the opening 66 in the top wall 64 may have an angular extent of no more than 110 degrees and may be angularly offset from the opening 46 in the bottom wall 44 of the first chamber, such as by between 90 and 180 degrees.

In an embodiment, the wiper 58 is provided with a plurality of arms 70, each attached to be rotatably driven by the spindle 54 and each with a free end 72 terminating closely adjacent to the outer wall 62. The arms 70 of the wiper 58 are angularly spaced apart from each other such that at least two arms 70 block all paths between the opening 46 in the first bottom wall and the second opening 52 in the second chamber, regardless of the rotational position of the wiper. For example, as shown in FIG. 3, the openings 46 and 52 may have an angular offset B of 180 degrees from each other, each with an angular extent A of no more than about 90 degrees. The wiper 58 may be provided with three arms 70, each positioned at 120 degrees from each other. In such an arrangement, for any given rotational position of the wiper 58 in the second chamber 48, at least one arm 70 will be positioned between the two openings 46, 52 in each rotational direction. In this situation, and when the arms 70 of the wiper 58 have a vertical extent 92 as great as a height 94 of the second chamber 48, that is, the distance between the first bottom wall 44 and the second bottom wall 60, then the arms 70 will prevent a flow of air between the two openings 46, 52. In other arrangements, where blockage of air flow is not of concern, the vertical extent 92 of the arms 70 need not be as great as the height 94 of the second chamber 48.

In an embodiment, the openings 66, 46, 52 in the top wall 64, the first bottom wall 44 and the second bottom wall 60 each have an angular extent A of no more than about 90 degrees.

In operation, ice from the ice making mechanism 20 passes through the opening 66 in the top wall 64 of the first chamber 42 and onto the bottom wall 44 of the first chamber. The ice crushing blade 56 is rotated by the spindle 54 and pushes the ice against a fixed member 96 to crush the ice into small pieces. The small pieces are then carried along by the rotating ice crushing blade 56 until they fall through the opening 46 in the bottom wall 44 of the first chamber 42. The crushed ice particles then fall to the bottom wall 60 of the second chamber 48 and they are pushed by the arm 70 of the rotating wiper 58 until they reach the side or bottom opening 52 in the second chamber where they will move through the opening 52 to be dispensed by another portion of the ice crushing mechanism 20 not described here. A possible dispensing arrangement is disclosed in U.S. Pat. No. 6,082,130, incorporated herein by reference.

Various features of the ice crushing mechanism 20 have been described which may be incorporated singly or in various combinations into a desired system.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An ice crushing mechanism comprising:

a housing having a first chamber and a second chamber, a rotatable spindle positioned in the housing extending essentially vertically through both the first and second chambers and defining a vertical rotational axis, the first chamber formed in the housing and defined by a first bottom wall with an opening therein, the second chamber formed below the first chamber in the housing and defined on top by the first bottom wall of the first chamber and also by a second wall with an opening therein angularly offset relative to the vertical axis from the first bottom wall opening, the second chamber forming a passage from the opening in the first bottom wall to the opening in the second wall, at least one ice crushing blade rotatably carried on the spindle and positioned in the first chamber, and a wiper rotatably carried on the spindle and positioned in the second chamber, said wiper being configured to have an arm portion positioned between the opening in the second wall and the opening in the first bottom wall, to block the passage between the opening in the second wall and the opening in the first bottom wall in all rotational positions of the wiper.

2. The ice crushing mechanism according to claim 1, wherein the second wall comprises a bottom wall of the second chamber.

3. The ice crushing mechanism according to claim 1, wherein the first chamber is further defined by a top wall with an opening therein angularly offset relative to the vertical axis from the first bottom wall opening.

4. The ice crushing mechanism according to claim 1, wherein the openings in the first bottom wall and the second wall each have an angular extent relative to the vertical axis of less than 90 degrees.

5. The ice crushing mechanism according to claim 1, wherein the first chamber and the second chamber are each defined by a circular outer wall.

6. The ice crushing mechanism according to claim 5, wherein the wiper arm portion comprises at least one arm attached to be rotatably driven by the spindle with a free end terminating closely adjacent to the outer wall defining the second chamber.

7. The ice crushing mechanism according to claim 6, wherein the wiper arm portion is made of a flexible and resilient material.

8. The ice crushing mechanism according to claim 5, wherein the wiper arm portion comprises three arms attached to be rotatably driven by the spindle, each with a free end terminating closely adjacent to the outer wall defining the second chamber.

9. An ice crushing mechanism comprising:

a housing having a first chamber and a second chamber, a rotatable spindle positioned in the housing extending essentially vertically through a central portion of both the first and second chambers and defining a vertical rotational axis, the first chamber formed in the housing and defined by a top wall with a first opening therein, a first bottom wall with a second opening having an angular extent relative to the vertical axis of no more than 110 degrees therein angularly offset relative to the vertical axis from the top wall opening and a circular outer wall, the second chamber formed below the first chamber in the housing and defined on top by the first bottom wall of the first chamber, on the bottom by a lower, second bottom wall with a third opening having an angular extent relative to the vertical axis of no more than 110 degrees therein angularly offset relative to the vertical axis from the first bottom wall opening by approximately 180 degrees and a circular outer wall, at least one ice crushing blade rotatably carried on the spindle and positioned in the first chamber, and a wiper rotatably carried on the spindle and positioned in the second chamber, the wiper comprising a plurality of arms, each attached to be rotatably driven by the spindle and each with a free end terminating closely adjacent to the outer wall, and each having a height equal to a height of the second chamber, the arms being angularly spaced apart relative to the vertical axis from each other such that at least two arms block all paths between the second opening and the third opening in all rotational positions of the wiper.

10. The ice crushing mechanism according to claim 9, wherein the openings in the top wall, the first bottom wall and the second bottom wall each have an angular extent relative to the vertical axis of less than 90 degrees.

11. The ice crushing mechanism according to claim 9, wherein the wiper arm is made of a flexible and resilient material.

12. A refrigeration appliance comprising:

a cabinet with a refrigerated compartment therein, an ice making mechanism located in the refrigerated compartment and arranged to make ice and to dispense the ice to an ice crushing mechanism, the ice crushing mechanism comprising:

a housing having a first chamber and second chamber, a rotatable spindle positioned in the housing extending essentially vertically through both the first and second chambers and defining a vertical rotational axis, the first chamber formed in the housing and defined by a first bottom wall with an opening therein, the second chamber formed below the first chamber in the housing and defined on the top by the first bottom wall of the first chamber and also by a second wall with an opening therein angularly offset relative to the vertical axis from the first bottom wall opening, the second chamber forming a passage between the opening in the first bottom wall and the opening in the second wall, at least one ice crushing blade rotatably carried on the spindle and positioned in the first chamber, and a wiper rotatably carried on the spindle and positioned in the second chamber, said wiper being configured to have an arm portion positioned between the opening in the second wall and the opening in the first bottom wall, to block the passage between the opening in the second wall and the opening in the first bottom wall in all rotational positions of the wiper.

13. The refrigeration appliance according to claim 12, wherein the second wall comprises a bottom wall of the second chamber.

14. The refrigeration appliance according to claim 12, wherein the first chamber is further defined by a top wall with an opening therein angularly offset relative to the vertical axis from the first bottom wall opening.

15. The refrigeration appliance according to claim 12, wherein the openings in the first bottom wall and the second wall each have an angular extent relative to the vertical axis of less than 90 degrees.

16. The refrigeration appliance according to claim 12, wherein the first chamber and the second chamber are each defined by a circular outer wall.

17. The refrigeration appliance according to claim 16, wherein the wiper arm portion is attached to the wiper to be rotatably driven by the spindle with a free end terminating adjacent to the outer wall defining the second chamber.

18. The refrigeration appliance according to claim 17, wherein the wiper arm portion is made of a flexible and resilient material.

19. The refrigeration appliance according to claim 16, wherein the wiper arm portion comprises three arms attached to be rotatably driven by the spindle, each with a free end terminating adjacent to the outer wall defining the second chamber.

* * * * *

UNITED STATES PATENT AND TRADEMARK OFFICE

CERTIFICATE OF CORRECTION

PATENT NO. : 8,220,283 B2
APPLICATION NO. : 11/870439
DATED : July 17, 2012
INVENTOR(S) : Eric R. Meyerholtz et al.

It is certified that error appears in the above-identified patent and that said Letters Patent is hereby corrected as shown below:

Col. 5, lines 14-18, Claim 6: "The ice crushing mechanism according to claim 5, wherein the wiper arm portion comprises at least one arm attached to be rotatably driven by the spindle with a free end terminating closely adjacent to the outer wall defining the second chamber." - should be
Claim 6: -- The ice crushing mechanism according to claim 5, wherein the wiper arm portion comprises at least one arm attached to be rotatably driven by the spindle with a free end terminating adjacent to the outer wall defining the second chamber. --

Col. 5, lines 22-26, Claim 8:" The ice crushing mechanism according to claim 5, wherein the wiper arm portion comprises three arms attached to be rotatably driven by the spindle, each with a free end terminating closely adjacent to the outer wall defining the second chamber." - should be
Claim 8: -- The ice crushing mechanism according to claim 5, wherein the wiper arm portion comprises three arms attached to be rotatably driven by the spindle, each with a free end terminating adjacent to the outer wall defining the second chamber. --

Col. 5, lines 27-56, Claim 9: "An ice crushing mechanism comprising: a housing having a first chamber and a second chamber, a rotatable spindle positioned in the housing extending essentially vertically through a central portion of both the first and second chambers and defining a vertical rotational axis, the first chamber formed in the housing and defined by a top wall with a first opening therein, a first bottom wall with a second opening having an angular extent relative to the vertical axis of no more than 110 degrees therein angularly offset relative to the vertical axis from the top wall opening and a circular outer wall, the second chamber formed below the first chamber in the housing and defined on top by the first bottom wall of the first chamber, on the bottom by a lower, second bottom wall with a third opening having an angular extent relative to the vertical axis of no more than 110 degrees therein angularly offset relative to the vertical axis from the first bottom wall opening by approximately 180 degrees and a circular outer wall, at least one ice crushing blade rotatably carried on the spindle and positioned in the first chamber, and a wiper rotatably carried on the spindle and positioned in the second chamber, the wiper comprising a plurality of arms, each attached to be rotatably driven by the spindle and each with a free end terminating closely adjacent to the outer wall, and each having a height equal to a height of the second chamber, the arms being Signed and Sealed this
Thirteenth Day of November, 2012

David J. Kappos

David J. Kappos
*Director of the United States Patent and Trademark Office* angularly spaced apart relative to the vertical axis from each other such that at least two arms block all paths between the second opening and the third opening in all rotational positions of the wiper." - should be
Claim 9: -- An ice crushing mechanism comprising: a housing having a first chamber and a second chamber, a rotatable spindle positioned in the housing extending essentially vertically through a central portion of both the first and second chambers and defining a vertical rotational axis, the first chamber formed in the housing and defined by a top wall with a first opening therein, a first bottom wall with a second opening having an angular extent relative to the vertical axis of no more than 110 degrees therein angularly offset relative to the vertical axis from the top wall opening and a circular outer wall, the second chamber formed below the first chamber in the housing and defined on top by the first bottom wall of the first chamber, on the bottom by a lower, second bottom wall with a third opening having an angular extent relative to the vertical axis of no more than 110 degrees therein angularly offset relative to the vertical axis from the first bottom wall opening by approximately 180 degrees and a circular outer wall, at least one ice crushing blade rotatably carried on the spindle and positioned in the first chamber, and a wiper rotatably carried on the spindle and positioned in the second chamber, the wiper comprising a plurality of arms, each attached to be rotatably driven by the spindle and each with a free end terminating adjacent to the outer wall, and each having a height equal to a height of the second chamber, the arms being angularly spaced apart relative to the vertical axis from each other such that at least two arms block all paths between the second opening and the third opening in all rotational positions of the wiper. --

Col. 6, lines 1-3, Claim 11: "The ice crushing mechanism according to claim 9, wherein the wiper arm is made of a flexible and resilient material." - should be
Claim 11: -- The ice crushing mechanism according to claim 9, wherein the wiper arms are made of a flexible and resilient material. --

Col. 6, lines 4-31, Claim 12: "A refrigeration appliance comprising: a cabinet with a refrigerated compartment therein, an ice making mechanism located in the refrigerated compartment and arranged to make ice and to dispense the ice to an ice crushing mechanism, the ice crushing mechanism comprising: a housing having a first chamber and second chamber, a rotatable spindle positioned in the housing extending essentially vertically through both the first and second chambers and defining a vertical rotational axis, the first chamber formed in the housing and defined by a first bottom wall with an opening therein, the second chamber formed below the first chamber in the housing and defined on the top by the first bottom wall of the first chamber and also by a second wall with an opening therein angularly offset relative to the vertical axis from the first bottom wall opening, the second chamber forming a passage between the opening in the first bottom wall and the opening in the second wall, at least one ice crushing blade rotatably carried on the spindle and positioned in the first chamber, and a wiper rotatably carried on the spindle and positioned in the second chamber, said wiper being configured to have an arm portion positioned between the opening in the second wall and the opening in the first bottom wall, to block the passage between the opening in the second wall and the opening in the first bottom wall in all rotational positions of the wiper." - should be Claim 12: -- A refrigeration appliance comprising: a cabinet with a refrigerated compartment therein, an ice making mechanism located in the refrigerated compartment and arranged to make ice and to dispense the ice to an ice crushing mechanism, the ice crushing mechanism comprising: a housing having a first chamber and a second chamber, a rotatable spindle positioned in the housing extending essentially vertically through both the first and second chambers and defining a vertical rotational axis, the first chamber formed in the housing and defined by a first bottom wall with an opening therein, the second chamber formed below the first chamber in the housing and defined on the top by the first bottom wall of the first chamber and also by a second wall with an opening therein angularly offset relative to the vertical axis from the first bottom wall opening, the second chamber forming a passage between the opening in the first bottom wall and the opening in the second wall, at least one ice crushing blade rotatably carried on the spindle and positioned in the first chamber, and a wiper rotatably carried on the spindle and positioned in the second chamber, said wiper being configured to have an arm portion positioned between the opening in the second wall and the opening in the first bottom wall, to block the passage between the opening in the second wall and the opening in the first bottom wall in all rotational positions of the wiper. --